US009140203B2

(12) United States Patent
Kothandaraman et al.

(10) Patent No.: US 9,140,203 B2
(45) Date of Patent: Sep. 22, 2015

(54) APPARENT PLUMBING VOLUME OF AIR INTAKE AND FRESH AIRFLOW VALUE DETERMINATION

(71) Applicant: Cummins Inc., Columbus, IN (US)

(72) Inventors: Govindarajan Kothandaraman, Columbus, IN (US); Vivek Sujan, Columbus, IN (US); Andrew Osburn, Nashville, IN (US); Ashwin Vyas, Columbus, IN (US)

(73) Assignee: Cummins Inc., Columbus, IN (US)

( * ) Notice: Subject to any disclaimer, the term of this patent is extended or adjusted under 35 U.S.C. 154(b) by 387 days.

(21) Appl. No.: 13/644,498

(22) Filed: Oct. 4, 2012

(65) Prior Publication Data

US 2013/0124068 A1 May 16, 2013

Related U.S. Application Data

(60) Provisional application No. 61/560,046, filed on Nov. 15, 2011.

(51) Int. Cl.

| | |
|---|---|
| ***F02D 41/18*** | (2006.01) |
| ***F02M 35/10*** | (2006.01) |
| ***F02M 25/07*** | (2006.01) |
| ***F02D 21/08*** | (2006.01) |

(52) U.S. Cl.

CPC ..... *F02D 41/18* (2013.01); *F02D 21/08* (2013.01); *F02M 25/0707* (2013.01); *F02M 35/10386* (2013.01); *F02D 2200/0402* (2013.01)

(58) Field of Classification Search

CPC ..... F02D 21/10; F02D 29/02; F02D 2200/04; F02D 41/0007; F02D 41/0072; F02D 41/18; F02M 25/07; F02M 25/0737; F02M 25/0707; Y02T 10/121; Y02T 10/126

USPC ..... 701/104, 108, 109, 114; 123/559.1, 123/559.2, 568.12, 568.16, 568.21, 568.22, 123/568.31; 60/605.2

See application file for complete search history.

(56) References Cited

U.S. PATENT DOCUMENTS

| | | | | |
|---|---|---|---|---|
| 6,035,639 | A | 3/2000 | Kolmanovsky et al. | |
| 6,101,998 | A * | 8/2000 | Tamura et al. | 123/295 |
| 6,370,935 | B1 | 4/2002 | He et al. | |
| 6,820,600 | B1 * | 11/2004 | Sisken et al. | 123/568.21 |
| 6,955,162 | B2 * | 10/2005 | Larson et al. | 123/568.11 |
| 6,999,882 | B2 | 2/2006 | Frie et al. | |
| 7,107,143 | B2 | 9/2006 | Kang | |
| 7,174,713 | B2 | 2/2007 | Nitzke et al. | |
| 7,267,117 | B2 | 9/2007 | Tonetti et al. | |
| 7,444,852 | B2 | 11/2008 | Fokkelman et al. | |
| 7,533,658 | B2 | 5/2009 | Chen | |
| 2002/0120384 | A1 * | 8/2002 | Takemura et al. | 701/109 |
| 2006/0282200 | A1 * | 12/2006 | Thiel et al. | 701/34 |
| 2007/0079614 | A1 * | 4/2007 | Barbe et al. | 60/605.2 |
| 2007/0119172 | A1 * | 5/2007 | Barbe et al. | 60/605.2 |

* cited by examiner

*Primary Examiner* — John Kwon
*Assistant Examiner* — Johnny H Hoang
(74) *Attorney, Agent, or Firm* — Taft Stettinius & Hollister LLP

(57) ABSTRACT

An apparatus for fresh airflow determination includes an operating conditions module that interprets a MAF value, a current operating condition and a charge flow value. The apparatus further includes a volume estimation module that determines an apparent plumbing volume of an air intake assembly in response to the MAF value, the current operating condition and the charge flow value. The apparatus further includes a volume reporting module that provides the apparent plumbing volume.

34 Claims, 7 Drawing Sheets

| ENGINE OPERATING CONDITION | APPARENT PLUMBING VOLUME |
|---|---|
| 700 RPM, 500 FT-LB | 140L |
| 1100 RPM, 500 FT-LB | 141L |
| 1400 RPM, 500 FT-LB | 125L |
| 700 RPM, 1000 FT-LB | 117L |
| 1100 RPM, 1000 FT-LB | 121L |
| 1400 RPM, 1000 FT-LB | 127L |
| 700 RPM, 1500 FT-LB | 119L |
| 1100 RPM, 1500 FT-LB | 140L |
| 1400 RPM, 1500 FT-LB | 150L |

230 218

FIG. 6

APPARENT PLUMBING VOLUME OF AIR INTAKE AND FRESH AIRFLOW VALUE DETERMINATION

CROSS-REFERENCE TO RELATED APPLICATIONS

This application claims the benefit of the filing date of provisional application No. 61/560,046 filed on Nov. 15, 2011, which is incorporated herein by reference.

BACKGROUND

The technical field generally relates to internal combustion engines having air intake assemblies. Environmental concerns have caused increased regulation and, therefore, exhaust gas regeneration (EGR) has become commonplace on many vehicles. Forced induction engines have increased air intake system plumbing, and therefore, increased maintenance of the plumbing. Many air intake systems are designed and installed in the aftermarket and, therefore, have an unknown volume. Therefore, further technological developments are desirable in this area.

SUMMARY

One embodiment is a unique method to determine an apparent plumbing volume of an air intake assembly. Other embodiments include unique methods, systems, and apparatus to determine an apparent plumbing volume of an air intake assembly, a fresh airflow value into an internal combustion engine, and an exhaust gas regeneration (EGR) flow value into the internal combustion engine. Further embodiments, forms, objects, features, advantages, aspects, and benefits shall become apparent from the following description and drawings.

BRIEF DESCRIPTION OF THE DRAWINGS

FIG. 6 is illustrative data relating specific parameters of an engine operating condition to an apparent plumbing volume.

DESCRIPTION OF THE ILLUSTRATIVE EMBODIMENTS

Figure 1:
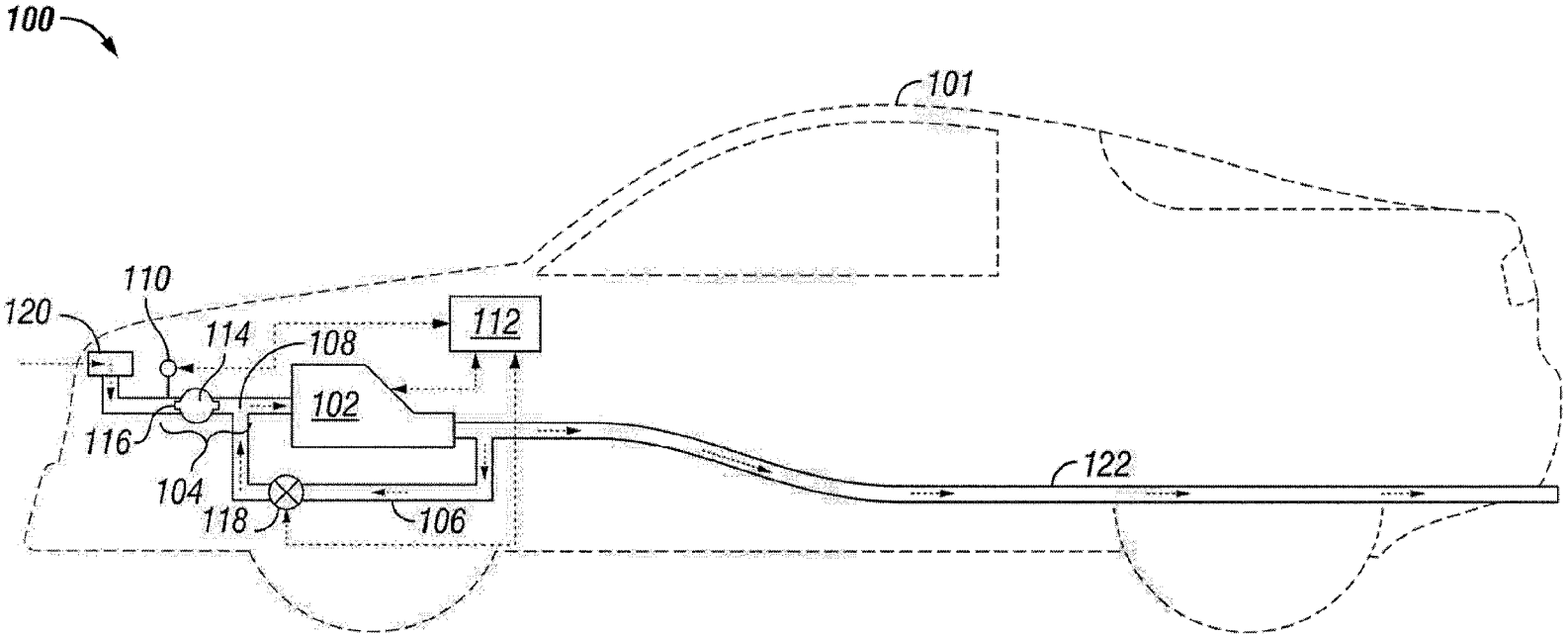
FIG. 1 is a schematic block diagram of a system for determining an apparent plumbing volume, a fresh airflow value and an exhaust gas regeneration (EGR) flow value.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

FIG. 1 is a schematic block diagram of a system 100 for determining an apparent plumbing volume, a fresh airflow value and an exhaust gas regeneration (EGR) flow value. An exemplary set of embodiments includes a system 100 including an internal combustion engine 102 having an air intake assembly 104, a mass airflow (MAF) sensor 110 operably coupled to the air intake assembly 104, and a controller 112 having modules structured to functionally execute operations for determining an apparent plumbing volume of the air intake assembly and for determining a fresh airflow into the internal combustion engine.

An exemplary internal combustion engine 102 is a diesel engine. However, it is contemplated that the internal combustion engine 102 may be a gasoline engine, a natural gas engine, an ethanol engine, and/or any other internal combustion engine 102 known to one of ordinary skill in the art. In an exemplary embodiment, the internal combustion engine 102 provides traction power to vehicle 101; however, it is contemplated that the internal combustion engine 102 may power a generator, a pump, or any other device which requires mechanical power as is known to one of ordinary skill in the art.

In FIG. 1, an air filter box 120 may allow air into the air intake assembly 104. In one embodiment, the air intake assembly 104 includes the plumbing (and volume associated therewith) from the MAF sensor 110 downstream to a point at which the charge flow is determined. The air intake assembly 104 may include plumbing which may include bends and/or elbows, air filtration devices and/or any other device. In another embodiment, the air intake assembly 104 includes the plumbing from the MAF sensor 110 downstream to an EGR outlet 108 (the EGR outlet 108 being the location at which the EGR inters the air intake) and/or EGR mixer. In further embodiments, the air intake assembly 104 may include plumbing from a location at which a MAF is modeled and/or calculated to a location downstream at which a charge flow is calculated and/or determined and/or at which an EGR outlet 108 and/or EGR mixer is present.

An exemplary system 100 further includes an EGR system 106 having an EGR outlet 108 operably coupled to the air intake assembly 104 downstream of the MAF sensor 110. The EGR system 106 diverts a portion of exhaust gas to be recirculated to the intake manifold rather than being discharged through exhaust pipe 122. In certain embodiments, the air intake assembly 104 further includes a turbocharger 114 having an air inlet 116, the air inlet 116 operably coupled to the air intake assembly 104 upstream of the EGR outlet 108 and downstream of the MAF sensor 110. In yet another embodiment, an EGR control valve 118 is operably coupled to the EGR system, the EGR control valve 118 selectively providing an EGR off operating condition. The MAF sensor 110 may be a hot-wire MAF, a hot-film MAF, a vane airflow meter and/or any other sensor or combination of sensors through which a MAF can be measured, sensed and/or calculated.

In certain embodiments, the system 100 further includes a controller 112 structured to perform certain operations to determine an apparent plumbing volume of an air intake assembly 104, to determine a fresh airflow value, and/or to determine an EGR flow value. In certain embodiments, the controller 112 forms a portion of a processing subsystem including one or more computing devices having memory, processing, and communication hardware. The controller 112 may be a single device or a distributed device, and the functions of the controller 112 may be performed by hardware or software. In certain embodiments, the controller 112 includes one or more modules structured to functionally execute the operations of the controller 112. In certain embodiments, the controller 112 includes: 1) an operating conditions module that interprets a mass airflow (MAF) value, a current operating condition, and a charge flow value; 2) a volume estimation module that determines an apparent plumbing volume of an air intake assembly in response to the MAF value, the current operating condition and the charge flow value; and 3) a volume reporting module that provides the apparent plumbing volume.

The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or software on computer readable medium, and modules may be distributed across various hardware or software components. More specific descriptions of certain embodiments of controller operations are included in the section referencing FIG. 2. Certain operations described herein include interpreting one or more parameters.

Interpreting, as utilized herein, includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a computer readable medium, receiving the value as a run-time parameter by any means known in the art, and/or by receiving a value by which the interpreted parameter can be calculated, and/or by referencing a default value that is interpreted to be the parameter value.

Figure 2:
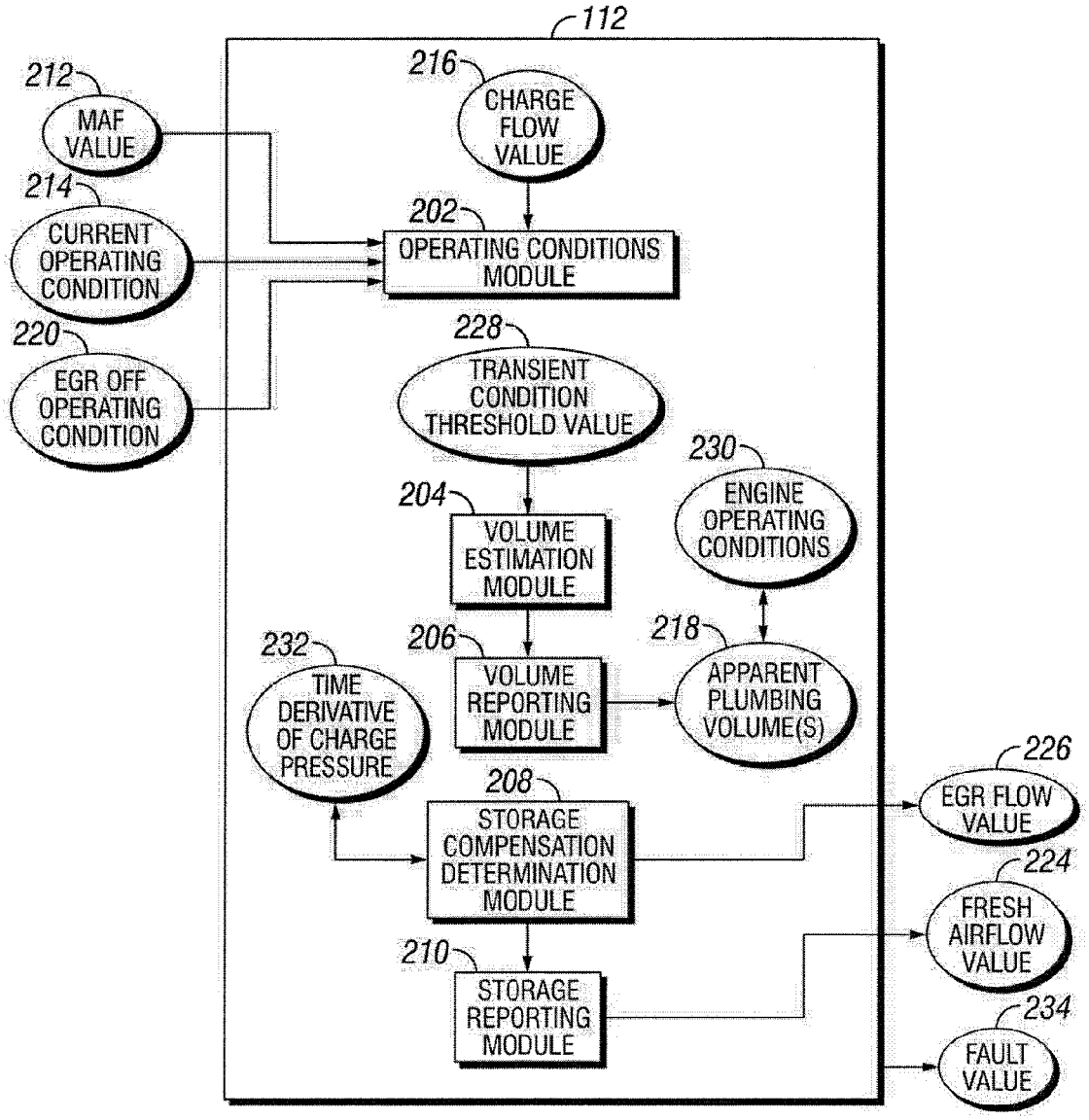
FIG. 2 is a schematic view of a controller that functionally executes certain operations to determine an apparent plumbing volume, a fresh airflow value and an EGR flow value.

FIG. 2 is a schematic view of a controller that functionally executes certain operations to determine an apparent plumbing volume, a fresh airflow value and an EGR flow value. The controller 112 includes an operating conditions module 202 that interprets a MAF value 212, a current operating condition 214 and a charge flow value 216.

The MAF value 212 may be measured, calculated and/or modeled. In one embodiment, the MAF value 212 may be the MAF. In other embodiments, the MAF value 212 may be any value that a MAF may be determined from as is known to one of skill in the art. Exemplary non-limiting MAF values 212 include a frequency output from MAF sensor 110, a voltage output from MAF sensor 110, a model that determines a MAF value in response to known or modeled engine operating conditions and/or any other value through which a MAF for a particular location may be determined.

In an exemplary embodiment, the current operation condition 214 includes any engine parameter which may affect and/or be correlated to the fresh airflow value 224. Exemplary current operation conditions 214 include engine speed, engine load, and/or engine fueling.

The charge flow value 216 may be measured, calculated, and/or modeled as is known to one of skill in the art. In some embodiments, the charge flow value 216 may be the charge flow of the internal combustion engine 102. In further embodiments, the charge flow value 216 may be any value which can be correlated (e.g. utilizing tables, charts, and/or calculations) to the charge flow of the internal combustion engine 102. The controller 112 further includes a volume estimation module 204 that determines an apparent plumbing volume 218 of the air intake assembly 104 in response to the MAF value 212, the current operating condition 214 and the charge flow value 216. The apparent plumbing volume 218 is a modeled and/or calculated volume for the plumbing between the location at which the MAF value 212 is determined and the location at which the charge flow is determined.

In some embodiments, the apparent plumbing volume 218 is the apparent volume of the air intake assembly 104. In another embodiment, the apparent plumbing volume 218 is a modeled and/or calculated volume for the plumbing between the location where the MAF value 212 is determined and the location at which an EGR outlet 108 and/or EGR mixer is present. An EGR mixer is any device known to one of skill in the art to mix EGR gas with fresh air prior to entrance into the internal combustion engine 102.

The apparent plumbing volume 218 may be characterized as a thermodynamic volume in that the pressure and temperature of the air flowing through the apparent plumbing volume 218 affect the time lag therein. In some embodiments, the apparent plumbing volume 218 may be characterized as a time lag correction, wherein the apparent plumbing volume 218 allows for a correction, due to the time lag caused by the plumbing between the airflow at an upstream location (e.g. at the MAF sensor location) and a downstream location (e.g. at the charge flow location).

In certain embodiments, the volume estimation module 204 determines the apparent plumbing volume 218 utilizing the equation:

$$V_{est} = \frac{(\dot{m}_{in} - \dot{m}_{chg})RT_{chg}}{\dot{P}_{chg}} \qquad \text{Equation 1}$$

wherein $\dot{m}_{in}$ is the MAF determined in response to the MAF value 212, $\dot{m}_{chg}$ is the charge flow value 216, $V_{est}$ is the apparent plumbing volume 218, $\dot{P}_{chg}$ is a time derivative of a charge pressure 232, R is a gas constant and $T_{chg}$ is a temperature of the charge flow value 216. In Equation 1, the variables may be measured, calculated and/or modeled.

The controller 112 further includes a volume reporting module 206 that provides the apparent plumbing volume 218. In some embodiments of the present invention, the apparent plumbing volume 218 is stored on the controller 112 as is shown in FIG. 2. Additionally or alternatively, it is contemplated that the apparent plumbing volume 218 may be stored as a parameter on a computer readable medium, and/or may be provided as a datalink value or communication.

In a further embodiment, the operating conditions module 202 interprets an EGR off operating condition 220, and the volume estimation module 204 determines the apparent plumbing volume 218 in response to the EGR off operating condition 220. In one embodiment, interpreting an EGR off operating condition 220 may further include sending a signal to EGR control valve 118 to close. In further embodiments, interpreting an EGR off operating condition 220 may include the controller 112 determining a period of time that EGR is not entering the internal combustion engine 102.

In a further embodiment, the controller 112 has a storage compensation determination module 208 that determines a fresh airflow value 224 in response to the current operating condition 214, the MAF value 212, the charge flow value 216 and the apparent plumbing volume 218. The fresh airflow value 224 includes the air that passes through the apparent plumbing volume 218 and enters the internal combustion engine 102. The fresh airflow value 224 is the amount of fresh airflow at the location where the charge flow value 216 is determined, modeled and/or calculated. In one embodiment of the present invention, the fresh airflow value 224 is the amount of fresh airflow that enters an air intake manifold of the internal combustion engine 102. In another embodiment of the present invention, the fresh airflow value 224 is the amount of fresh airflow after an EGR mixer.

In certain embodiments, the MAF is the fresh air entering the air intake assembly 104, and the fresh airflow is the fresh air exiting the air intake assembly 104. Accordingly, the MAF and the fresh airflow are substantially the same value when the flow in the intake of the engine 102 is in steady state. During transient flow conditions, the fresh airflow is lagged relative to the MAF. The lag value is not a simple time lag, because the flow conditions (flow rate, rate of change, flow temperature, etc.) affect the differences between the fresh airflow and the MAF. Therefore, in certain embodiments, a correction utilizing the apparent plumbing volume 218 provides a more accurate value of the fresh airflow than a simple estimate utilizing the MAF without any lag compensation. However, the apparent plumbing volume 218 may be utilized in any manner described herein without limitation to a theory or mechanism of operation.

In certain embodiments, the storage compensation determination module 208 determines the fresh airflow value 224 utilizing the equation:

$$\dot{m}_2 = \dot{m}_{in} - \frac{\dot{P}_{chg} V_{est}}{RT_{chg}} \qquad \text{Equation 2}$$

wherein $\dot{m}_2$ is the fresh airflow value 224, $\dot{m}_{in}$ is the MAF determined in response to the MAF value 212, $V_{est}$ is the apparent plumbing volume 218, $\dot{P}_{chg}$ is a time derivative of a charge pressure 232, R is a gas constant and $T_{chg}$ is a temperature of the charge flow value 216. In certain embodiments, the controller 112 further includes a storage reporting module 210 for providing the fresh airflow value 224. In Equation 2, it is contemplated that the variables may be measured, calculated and/or modeled.

It is contemplated that the storage reporting module 210 may provide the fresh airflow value 224 in any manner useful to system 100 and/or to a remote terminal which may be in communication with system 100. Exemplary embodiments of providing the fresh airflow value 224 include storing the fresh airflow value 224 within controller 112 (e.g. to be utilized to calculate an EGR flow value 226), providing the fresh airflow value 224 to a datalink and/or storing the fresh airflow value 224 as a parameter on a computer readable medium.

An exemplary embodiment further includes an EGR system 106 operably coupled to the air intake assembly 104. The storage compensation determination module 208 may determine an EGR flow value 226 in response to the fresh airflow value 224 and the charge flow value 216. The EGR flow value 226 is representative of the amount of exhaust gas that enters the internal combustion engine 102. In an exemplary embodiment, the EGR flow value 226 is determined by subtracting the fresh airflow value 224 from the charge flow value 216.

In certain embodiments, the volume estimation module 204 determines the apparent plumbing volume 218 in response to a transient condition value exceeding a transient condition threshold value 228. The current operation condition 214 is utilized to determine if a transient condition is present in the fresh airflow value 224.

The transient condition value, as utilized herein, includes a description of any transient event relating to the fresh airflow value 224 of the internal combustion engine 102. The description may be qualitative (e.g. low/medium/high transient event) or quantitative (e.g. δengine speed/δt; δfueling/δt; δMAF/δt, δMAF/δexecution cycle, etc.). A transient event relating to the fresh airflow value 224 of the internal combustion engine 102 includes any operation of the system that causes a dynamic change in the fresh airflow value 224 with time. For example, an engine speed change, an engine load change, a turbocharger 114 position or speed change, an accelerator pedal position change and/or any other system change known to one of skill in the art to affect the fresh airflow value 224 is contemplated herein.

The amount of change required to be considered a transient, or to exceed the transient condition threshold value 228, is dependent upon the requirements of the system, including the desired accuracy of the apparent volume estimate and the accuracy of any underlying estimates or determinations of the fresh airflow value 224 and the charge flow value 216. For example, a high desired accuracy in the apparent plumbing volume 218 indicates that a higher transient condition threshold value 228 may be utilized to determine if a transient is occurring. A low accuracy of the fresh airflow value 224 and/or charge flow value 216 accuracy indicates that a lower transient condition threshold value 228 may be utilized to determine whether a transient is occurring. One of skill in the art, having the benefit of the disclosures herein, can readily determine the rate of change of the operating conditions that provides a sufficient transient to determine an acceptably accurate apparent plumbing volume 218 through simple data gathering with a contemplated system.

In a further embodiment, the volume estimation module 204 determines a plurality of apparent plumbing volumes 218, each apparent plumbing volume 218 corresponding to an engine operating condition 230. The volume estimation module 204, in response to the current operating condition 214 and the plurality of apparent plumbing volumes 218 corresponding to engine operating conditions 230, determines an apparent plumbing volume 218.

In certain embodiments of the present invention, it is contemplated that the volume estimation module 204 determines a plurality of apparent plumbing volumes 218 corresponding to the engine operating conditions 230. To determine the apparent plumbing volume 218, a closest one of the plurality of apparent plumbing volumes 218 may be selected, and/or an apparent plumbing volume 218 may be interpolated, extrapolated, averaged, or selected from the plurality of apparent plumbing volumes 218 by any method understood in the art.

The engine operating conditions 230 include any parameters and/or values which may be correlated to a particular current operating condition 214, and in certain embodiments include operating conditions that are expected to provide a similar flow environment in the air intake assembly 104. Exemplary engine operating conditions 230 include, but are not limited to, engine speed, engine load, engine fueling, charge flow value, engine exhaust temperature, and/or any other parameter and/or value that can be correlated to a particular current operating condition 214. It should be understood that the current operating condition 214 and the engine operating conditions 230 may be in the same units. In certain embodiments, the engine operating conditions 230 and current operating condition 214 are provided in distinct units.

FIG. 6 illustrates a plurality of engine operating conditions 230, each corresponding to one of a plurality of apparent plumbing volumes 218. In an exemplary embodiment, the volume estimation module 204 utilizes a current operating condition 214 to determine which of the apparent plumbing volumes 218 to utilize. An exemplary operation includes determining which engine operating condition 230 most closely matches the current operating condition 214, and selecting the corresponding apparent plumbing volume 218. Another exemplary operation includes determining two or more engine operating conditions 230 that bound the current operating condition 214, and selecting the apparent plumbing volume 218 as a weighted average of the apparent plumbing volumes 218 that correspond to the engine operating conditions 230 bounding the current operating condition 214. In the example of FIG. 6, an exemplary current operating condition 214 is provided in units corresponding to the engine operating conditions 230 (e.g. engine speed and engine torque). Additionally or alternatively, the current operating condition 214 may be provided in units that can be correlated to the engine operating conditions 230 (e.g. a current engine power output amount). All descriptions of operations utilizing the parameters illustrated in FIG. 6 are exemplary and non-limiting.

Figure 3:
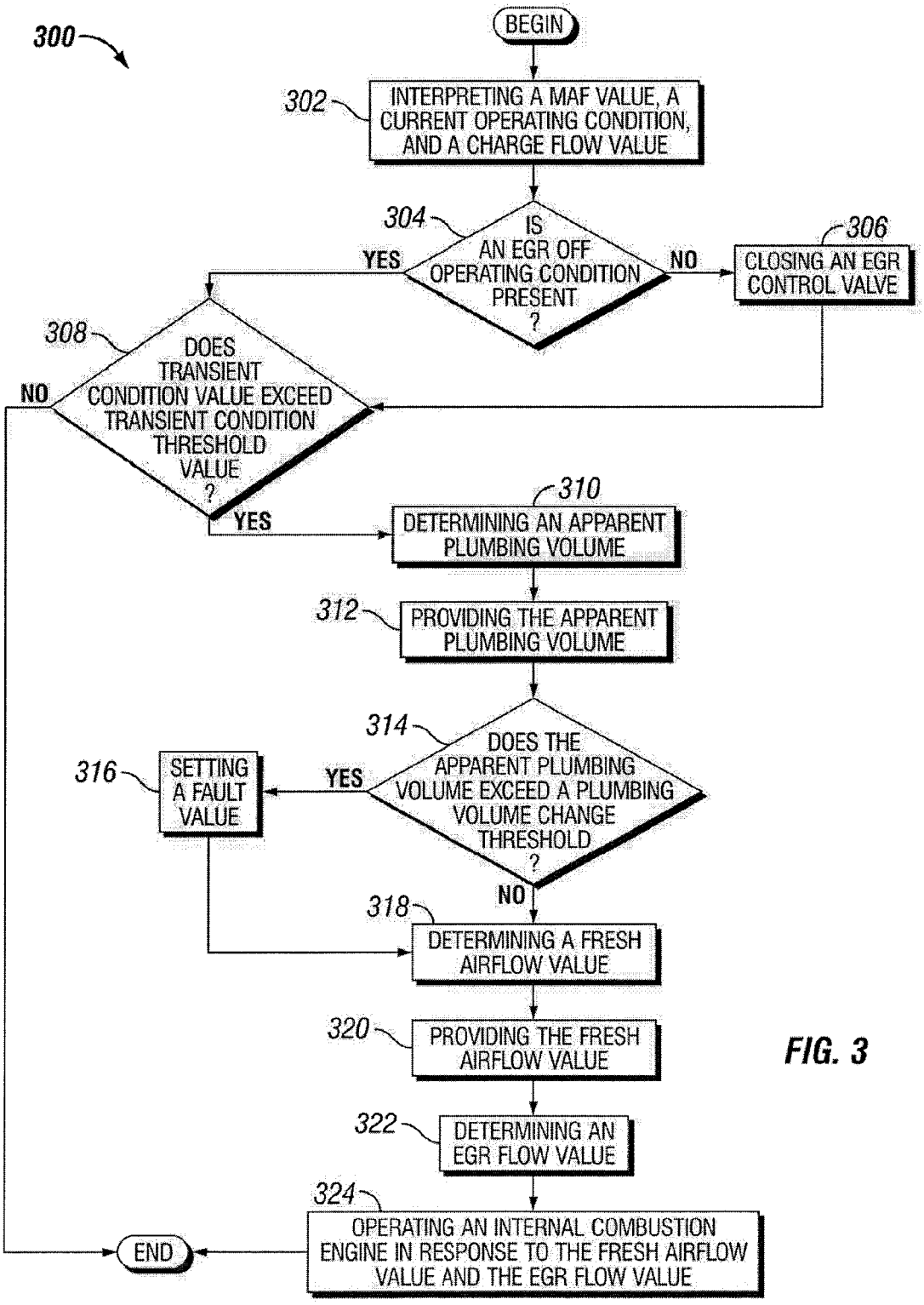
FIG. 3 is a schematic flow diagram of a procedure for determining an apparent plumbing volume, a fresh airflow value and an EGR flow value.

FIG. 3 is a schematic flow diagram of a procedure for determining an apparent plumbing volume, a fresh airflow value and an EGR flow value. Operations illustrated are understood to be exemplary only, and operations may be combined or divided, and added or removed, as well as reordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

In an exemplary embodiment, the procedure 300 includes an operation 302 to interpret a mass airflow (MAF) value, a current operating condition and a charge flow value. The procedure further includes a determination operation 304 to determine if an EGR off operating condition is present. In response to the determination operation 304 having an output of NO, the procedure 300 includes an exemplary operation 306 to close an EGR control valve to achieve the EGR off operating condition. The operation 306 may be subject to additional checks and/or conditions, for example a determination of whether an EGR off operating conditions is available under the present operating conditions. However, for purposes of clear description of the operations herein, any additional checks or conditions are omitted.

In response to the determination operation 304 having an output of YES, the procedure 300 includes a determination operation 308 to determine if a transient condition value exceeds a transient condition threshold value. In response to the determination operation 308 having a NO output, the exemplary procedure 300 ends. In response to the determination operation 308 having a YES output, the procedure 300 includes an operation 310 to determine an apparent plumbing volume of an air intake assembly in response to the MAF value, the current operating condition and the charge flow value. An operation 312 provides the apparent plumbing volume.

A determination operation 314 determines if the apparent plumbing volume exceeds a plumbing volume change threshold. The plumbing volume change threshold may be set to an absolute value of the apparent plumbing volume that is expected, and/or may be set to a change amount in the apparent plumbing volume that is consistent with proper operation of the air intake assembly. For example, where a range of potential turbocharger routing schemes are expected to provide apparent plumbing volumes between 60 L and 100 L, the plumbing volume change threshold may be set to 120 L (a fault is set for any apparent plumbing volume over 120 L), or to a 40 L change value (a fault is set for any apparent plumbing volume change observed to be over 40 L). In response to the determination operation 314 having a YES output, an operation 316 sets a fault value. In response to the determination operation 314 having a NO output, an operation 318 determines a fresh airflow value in response to the current operating condition, the MAF value, the charge flow value and the apparent plumbing volume.

An operation 320 provides the fresh airflow value. An operation 322 determines an EGR flow value in response to the fresh airflow value and the charge flow value. An operation 324 operates an internal combustion engine in response to the fresh airflow value and the EGR flow value.

In some embodiments, the operation 318 determines a fresh airflow value in response to the current operating condition, the MAF value, the charge flow value and a stored apparent plumbing volume. The stored apparent plumbing volume can be a previously determined apparent plumbing volume, a previously determined apparent plumbing volume which compensates for the current operating condition, and/or one of a series of tabulated apparent plumbing volumes. In some embodiments, the stored apparent plumbing volume is utilized in response to an engine fault condition, including, but not limited to, a determination that most recently determined apparent plumbing volume is inaccurate (e.g. through incomplete combustion due to excessive EGR). The operations 320, 322 and 324 can follow the operation 318 as aforementioned.

Figure 4:
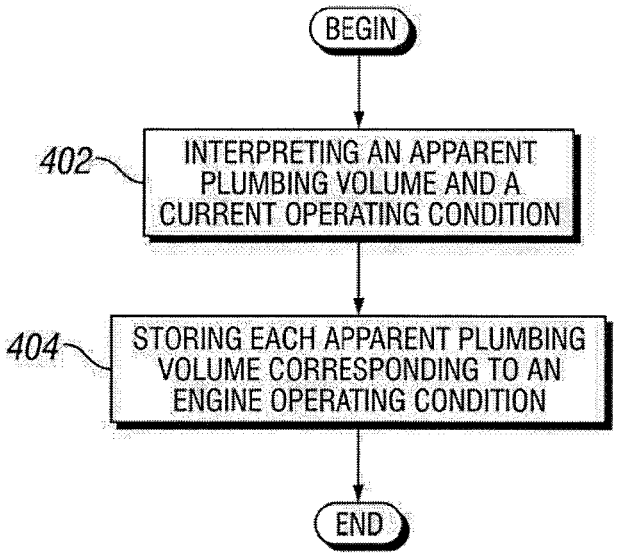
FIG. 4 is a schematic flow diagram of a procedure for storing apparent plumbing volume values, each apparent plumbing volume value corresponding to an engine operating condition.
Figure 5:
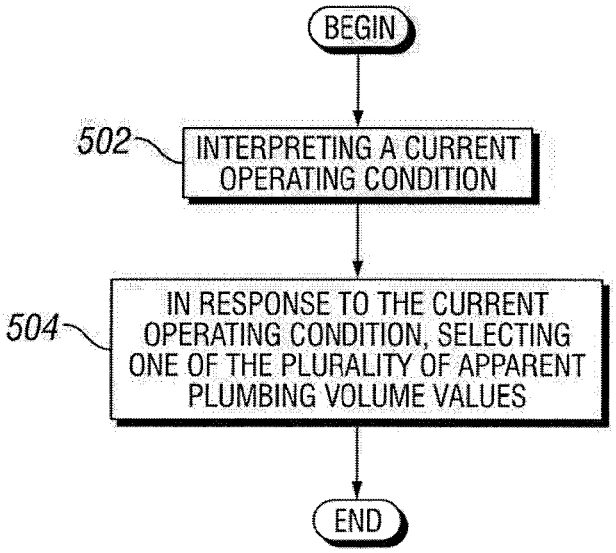
FIG. 5 is a schematic flow diagram of a procedure for determining an apparent plumbing volume in response to a current operating condition and the values stored in FIG. 4.

FIG. 4 is a schematic flow diagram of a procedure for storing apparent plumbing volume values, each apparent plumbing volume value corresponding to an engine operating condition. FIG. 5 is a schematic flow diagram of a procedure for determining an apparent plumbing volume in response to a current operating condition and the values stored in FIG. 4. The procedures illustrated in FIG. 4 and FIG. 5 are consistent with procedures that may be incorporated into procedure 300.

An operation 402 interprets an apparent plumbing volume 218 and a current operating condition 214. An operation 404 stores each apparent plumbing volume 218, each apparent plumbing volume 218 corresponding to an engine operating condition 230. Accordingly, the procedure of FIG. 4 provides a plurality of apparent plumbing volumes 218 corresponding to one of a plurality of engine operating conditions 230.

An operation 502 interprets a current operating condition 214. An operation 504 selects one of the plurality of apparent plumbing volume values 218 in response to the current operating condition 214. Accordingly, the procedure of FIG. 5 provides for selecting one of a plurality of apparent plumbing volumes 218 corresponding to one of a plurality of engine operating conditions, according to a current operating condition 214.

Figure 7:
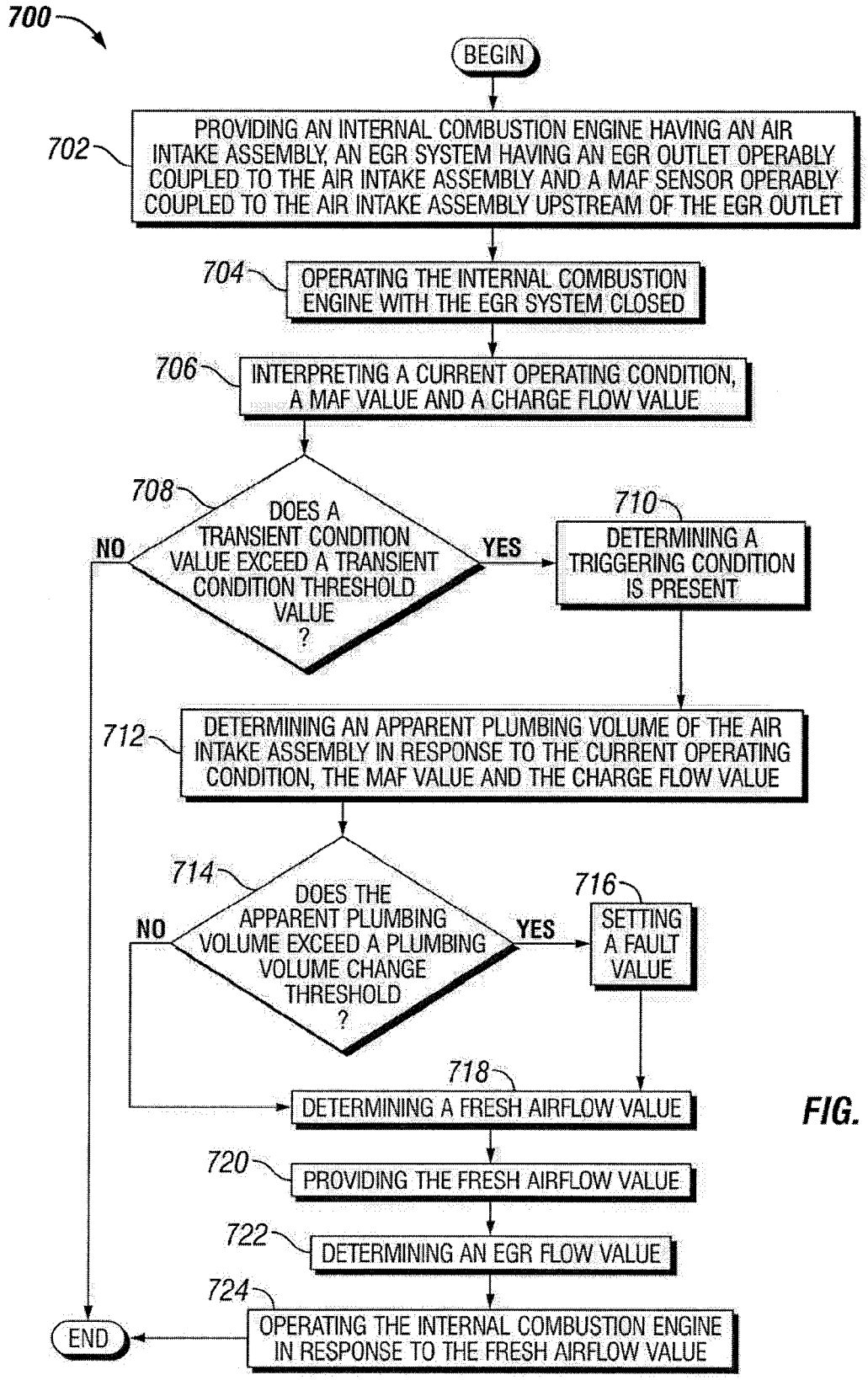
FIG. 7 is a schematic flow diagram of a procedure for determining an apparent plumbing volume, a fresh airflow value and an EGR flow value.

FIG. 7 is a schematic flow diagram of a procedure 700 for determining an apparent plumbing volume, a fresh airflow value and an EGR flow value. The procedure 700 begins by an operation 702 providing an internal combustion engine having an air intake assembly, an EGR system having an EGR outlet operably coupled to the air intake assembly and a MAF sensor operably coupled to the air intake assembly upstream of the EGR outlet. An operation 704 operates the internal combustion engine with the EGR system closed. An operation 706 interprets a current operating condition, a MAF value and a charge flow value. A determination operation 708 determines if a transient condition value exceeds a transient condition threshold value. In response to the determination operation 708 having a NO output, the exemplary procedure ends. In response to the determination operation 708 having a YES output, an operation 710 determines if a triggering condition is present.

Exemplary triggering conditions include a first startup event of an internal combustion engine (e.g. after manufacture, after initialization of an engine control module, etc.), a startup event of an internal combustion engine and a service event. Further exemplary triggering conditions include any condition which alters an apparent plumbing volume corresponding to a particular engine operating condition, and/or any condition that indicates a check for an altered apparent plumbing volume corresponding to a particular engine operating condition is desirable. Further exemplary and non-limiting triggering conditions include installing a new air filtration unit, changing a routing of the air intake assembly, any service event that modifies or adjusts the air intake assembly and/or a large change in an ambient condition (e.g. ambient temperature or pressure).

An operation 712 determines an apparent plumbing volume of the air intake assembly in response to the current operating condition, the MAF value and the charge flow value. A determination operation 714 determines if the apparent plumbing volume exceeds a plumbing volume change threshold. In response to the determination operation 714 having a YES output, an operation 716 sets a fault value. In response to the determination operation 714 having a NO output, an operation 718 determines a fresh airflow value. An operation 720 provides the fresh airflow value. An operation 722 determines an EGR flow value and an operation 724 operates the internal combustion engine in response to the fresh airflow value.

In some embodiments, the operation 718 determines a fresh airflow value in response to the current operating condition, the MAF value, the charge flow value and a stored apparent plumbing volume. The stored apparent plumbing volume can be a previously determined apparent plumbing volume, a previously determined apparent plumbing volume which compensates for the current operating condition, and/or one of a series of tabulated apparent plumbing volumes. In some embodiments, the stored apparent plumbing volume is utilized in response to an engine fault condition, including, but not limited to, a determination that most recently determined apparent plumbing volume is inaccurate (e.g. through excessive NOx output due to a low EGR flow rate). The operations 720, 722 and 724 can follow the operation 318 as aforementioned.

Figure 8:
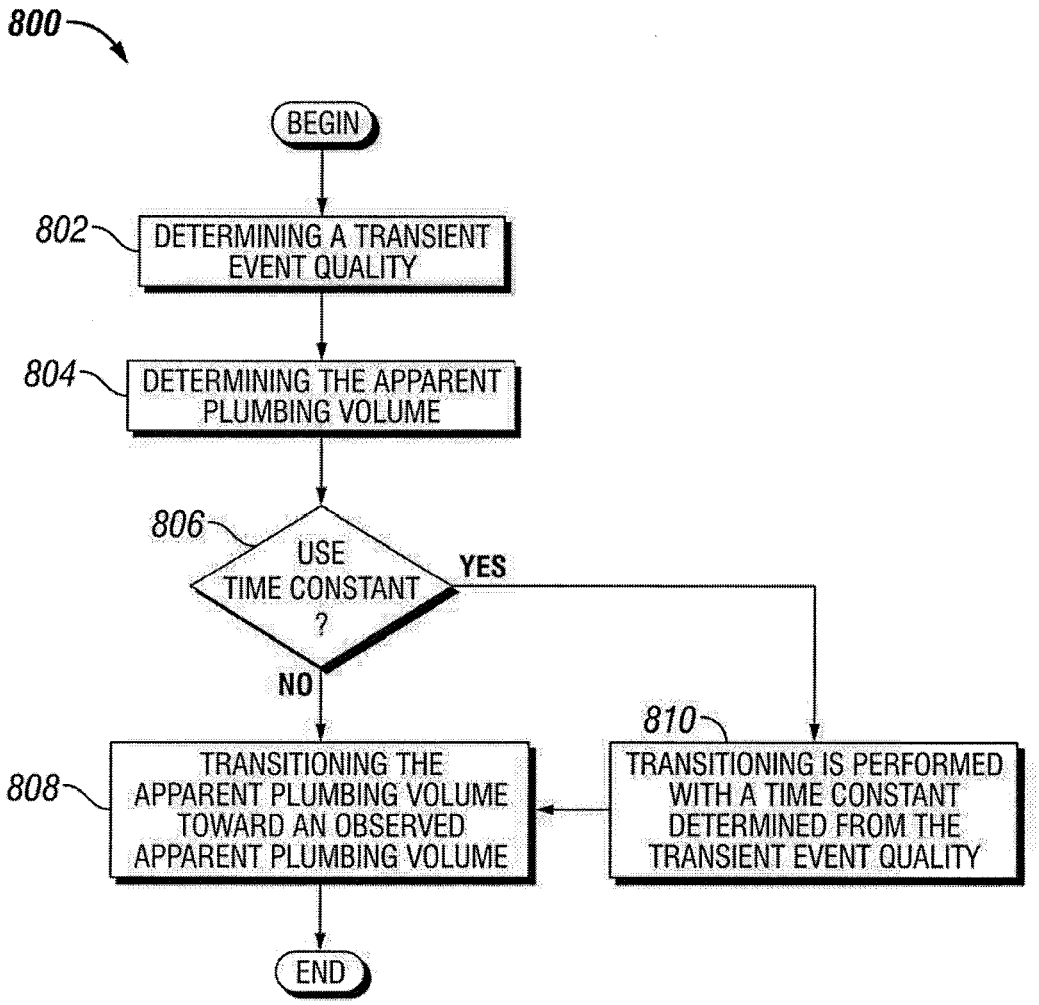
FIG. 8 is a schematic flow diagram of a procedure for determining an apparent flow volume in response to a transient event quality.

FIG. 8 is a schematic flow diagram of a procedure for determining an apparent flow volume in response to a transient event quality. A procedure 800 begins with an operation 802 that determines a transient event quality.

A transient event quality, as utilized herein, indicates a qualitative or quantitative description of the quality of a transient event in providing an accurate and/or reliable estimate of the apparent plumbing volume. For example, a large and rapid transient event provides a better signal to noise environment for determining the apparent plumbing volume and accordingly provides a higher transient event quality. In certain embodiments, the transient event quality is utilized to determine how quickly the apparent plumbing volume is updated to the observed apparent plumbing volume.

In one example, the transient event quality is very high, and the apparent plumbing volume is immediately changed to the observed apparent plumbing volume during the transient event. In another example, the transient event quality is very low, and the apparent plumbing volume is not changed toward the observed apparent plumbing volume during the transient event. In certain embodiments, the apparent plumbing volume is changed toward the observed apparent plumbing volume over a period of time or over a number of processor execution cycles, where a time constant of the change is determined in response to the transient event quality. For example, a low transient event quality may indicate a slow change—e.g. a 60-second time constant, a medium transient event quality may indicate a medium change—e.g. a 15-second time constant, and a high transient event quality may indicate a rapid change—e.g. a 5-second time constant.

In the example, during operating periods where the transient is observed the apparent plumbing volume is being transitioned, and during operating periods where no transient is observed, the apparent plumbing volume is not being transitioned. The time constant may be applied to a filter, moving average and/or any other smoothing function that dampens the rate of change of the apparent plumbing volume to the observed plumbing volume. All operations, time constants and descriptions of the transient event quality herein are exemplary and non-limiting.

An operation 804 determines the apparent plumbing volume. A determination operation 806 determines if a time constant will be used. In response to the determination operation 806 having a YES output, an operation 810 performs a transitioning with a time constant predetermined from the transient event quality. In response to the determination operation 806 having a NO output, an operation 808 transitions the apparent plumbing volume toward an observed apparent plumbing volume.

In an exemplary embodiment, the apparent plumbing volume is the plumbing volume which is being used by the system, method or apparatus at the current time. The observed plumbing volume is the updated apparent plumbing volume that is being presently determined during a transient event (e.g. as calculated utilizing Equation 1). The apparent plumbing volume is the volume presently utilized in controlling the engine, including e.g. in determining the fresh airflow and/or the EGR flow. The apparent plumbing volume, in one example, is determined from a table such as illustrated in FIG. 6, while the observed plumbing volume is utilized to update the values in the table on an ongoing basis during transient flow periods and/or in response to triggering conditions.

As will be understood to one of ordinary skill in the art with the aid of this disclosure, in some embodiments, the apparent plumbing volume is moved toward the observed apparent plumbing volume. When moving toward the observed apparent plumbing volume, the apparent plumbing volume may be multiplied by a correction factor, utilizing an offset table, and or utilizing a step and/or filtered response value. Through the use of a filtered response value, the apparent plumbing volume may be moved over a period of steps toward the observed apparent plumbing volume. In some embodiments, as the quality of the transient event increases, the speed at which the apparent plumbing volume moves toward the observed apparent plumbing volume increases.

In additional or alternative embodiments, a time constant is determined in response to the transient event quality. As will be understood to one of ordinary skill with the aid of the disclosure, the time constant may vary greatly depending on the transient event quality. The time constant may decrease as the transient event quality increases (e.g. as the accuracy of the transient event increases, the time constant over which the apparent plumbing volume moves toward the observed apparent plumbing volume will decrease).

It is contemplated that procedure 800 may be incorporated into procedure 700 and/or procedure 300, may be separate procedures and/or may be incorporated into a processing subsystem. In further embodiments, the procedure includes determining if the apparent plumbing volume 218 exceeds a plumbing volume change threshold; and in response to the apparent plumbing volume exceeding the plumbing volume change threshold, the procedure includes setting a fault value 234. In one embodiment of the present invention, the plumbing volume change threshold may be determined by operating the internal combustion engine 102 over a broad spectrum of transient conditions and setting the plumbing volume change threshold in response to a maximum plumbing volume observed. The fault value 234 may appear as an error code (e.g. on an OBD output), as a light, as a diagnostic code to be read directly from the ECU and/or any other fault value 234 available to an operator and/or service technician.

As is evident from the figures and text presented above, a variety of embodiments according to the present invention are contemplated. An exemplary set of embodiments is a system including an internal combustion engine having an air intake assembly, a mass airflow (MAF) sensor operably coupled to the air intake assembly, and a controller having modules structured to functionally execute operations for determining an apparent plumbing volume of the air intake assembly and for determining a fresh airflow value into the internal combustion engine. The controller includes an operating conditions module that interprets a mass airflow (MAF) value, a current operating condition, and a charge flow value. The controller further includes a volume estimation module that determines an apparent plumbing volume of an air intake assembly in response to the MAF value, the current operating condition and the charge flow value. The controller further includes a volume reporting module that provides the apparent plumbing volume.

An exemplary internal combustion engine includes a diesel engine. An exemplary system further includes an exhaust gas recirculation (EGR) system having an EGR outlet operably coupled to the air intake assembly downstream of the MAF sensor. In certain embodiments, the air intake assembly further includes a turbocharger having an air inlet, the air inlet operably coupled to the air intake assembly upstream of the EGR outlet and downstream of the MAF sensor. In a further embodiment, the operating conditions module interprets an EGR off operating condition, and the volume estimation module determines the apparent plumbing volume in response to the EGR off operating condition. In yet another embodiment, an EGR control valve is operably coupled to the EGR system, the EGR control valve selectively providing the EGR off operating condition.

An exemplary system further includes the controller having a storage compensation determination module that determines a fresh airflow value in response to the current operating condition, the MAF value, the charge flow value and the apparent plumbing volume. In certain embodiments, the controller further includes a storage reporting module providing the fresh airflow value.

In certain embodiments, the volume estimation module determines the apparent plumbing volume utilizing the equation $$V_{est} = \frac{(\dot{m}_{in} - \dot{m}_{chg})RT_{chg}}{\dot{P}_{chg}}$$

wherein $\dot{m}_{in}$ is the MAF determined in response to the MAF value, $\dot{m}_{chg}$ is the charge flow value, $V_{est}$ is the apparent plumbing volume, $\dot{P}_{chg}$ is a time derivative of a charge pressure, R is a gas constant and $T_{chg}$ is a temperature of the charge flow value. In further embodiments, the storage compensation determination module to determines a fresh airflow value utilizing the equation $$\dot{m}_2 = \dot{m}_{in} - \frac{\dot{P}_{chg}V_{est}}{RT_{chg}}$$

wherein $\dot{m}_2$ is the fresh airflow value, $\dot{m}_{in}$ is the MAF determined in response to the MAF value, $V_{est}$ is the apparent plumbing volume, $\dot{P}_{chg}$ is a time derivative of a charge pressure, R is a gas constant and $T_{chg}$ is a temperature of the charge flow value.

Another exemplary set of embodiments is an apparatus including an operating conditions module that interprets a mass airflow (MAF) value, a current operating condition, and a charge flow value. The apparatus further includes a volume estimation module that determines an apparent plumbing volume of an air intake assembly in response to the MAF value, the current operating condition and the charge flow value. The apparatus further includes a volume reporting module that provides the apparent plumbing volume.

In certain embodiments, the operating conditions module interprets an exhaust gas regeneration (EGR) off operating condition, and the volume estimation module determines the apparent plumbing volume in response to the EGR off operating condition. An exemplary apparatus further includes, a storage compensation determination module determines a fresh airflow value in response to the current operating condition, the MAF value, the charge flow value and the apparent plumbing volume. In some embodiments, a storage reporting module provides the fresh airflow value.

An exemplary apparatus further includes, an EGR system operably coupled to the air intake assembly. The storage compensation determination module may determine an EGR flow value in response to the fresh airflow value and the charge flow value.

In certain embodiments, the volume estimation module determines the apparent plumbing volume in response to a transient condition value exceeding a transient condition threshold value. In further embodiments, the volume estimation module determines a plurality of apparent plumbing volumes, each apparent plumbing volume corresponding to an engine operating condition, and wherein in response to the current operating condition and the plurality of apparent plumbing volumes corresponding to engine operating conditions, the volume estimation module determines an apparent volume.

Yet another exemplary set of embodiments is a method, including interpreting a mass airflow (MAF) value, a current operating condition, and a charge flow value. The method further includes determining an apparent plumbing volume of an air intake assembly in response to the MAF value, the current operating condition and the charge flow value. The method further includes providing the apparent plumbing volume.

In certain embodiments, the method further includes interpreting an exhaust gas regeneration (EGR) off operating condition, and determining the apparent plumbing volume in response to the EGR off operating condition. In certain further embodiments, the method further includes determining a fresh airflow value in response to the current operating condition, the MAF value, the charge flow value and the apparent plumbing volume, and providing the fresh airflow value. In further embodiments, the method further includes determining an EGR flow value in response to the fresh airflow value and the charge flow value.

In another embodiment, the method further includes operating an internal combustion engine in response to the fresh airflow value and the EGR flow value. In a further embodiment, the method further includes storing a plurality of apparent plumbing volume values, each apparent plumbing volume value corresponding to an engine operating condition. In further embodiments, in response to the current operating condition, the method further includes selecting one of the plurality of apparent plumbing volume values.

In certain embodiments, the method includes determining the fresh airflow value further comprises determining the time derivative of a charge pressure. In further embodiments, the method includes determining if the apparent plumbing volume exceeds a plumbing volume change threshold; and in response to the apparent plumbing volume exceeding the plumbing volume change threshold, setting a fault value.

Yet another exemplary set of embodiments is a method including providing an internal combustion engine having an air intake assembly, an EGR system having an EGR outlet operably coupled to the air intake assembly and a MAF sensor operably coupled to the air intake assembly upstream of the EGR outlet. The method further includes operating the internal combustion engine with the EGR system closed. The method further includes interpreting a current operating condition, a MAF value and a charge flow value. The method further includes determining an apparent plumbing volume of the air intake assembly in response to the current operating condition, the MAF value and the charge flow value. The method further includes determining a fresh airflow value in response to the current operating condition, the MAF value, the charge flow value and the apparent plumbing volume. The method further includes providing the fresh airflow value.

In certain embodiments, the method includes determining an apparent plumbing volume in response to a transient condition value exceeding a transient condition threshold value. In a further embodiment, the method includes determining a transient event quality, and wherein determining the apparent plumbing volume is further in response to the transient event quality. In yet a further embodiment, the method includes determining the apparent plumbing volume further in response to the transient event quality includes transitioning the apparent plumbing volume toward an observed apparent plumbing volume. In some embodiments, the method includes wherein the transitioning is performed with a time constant determined from the transient event quality.

In yet further embodiments, the method includes setting a fault value in response to the apparent plumbing volume exceeding a plumbing volume change threshold. In further embodiments, the method includes determining an EGR flow value in response to the fresh airflow value and the charge flow value. In further embodiments, wherein determining an apparent plumbing volume of the air intake further includes determining a triggering condition is present, and in response to the triggering condition, determining an apparent plumbing volume. In yet further embodiments, the triggering condition is selected from the group of triggering conditions consisting of an initial internal combustion engine startup, an internal combustion engine startup, and a service event. In certain embodiments, the method may further include operating the internal combustion engine in response to the fresh airflow value.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an internal combustion engine having an air intake assembly;

a mass airflow (MAF) sensor operably coupled to the air intake assembly;

a controller comprising:

an operating conditions module structured to interpret a MAF value, a current operating condition, and a charge flow value;

a volume estimation module structured to determine an apparent plumbing volume of the air intake assembly in response to the MAF value, the current operating condition and the charge flow value; and a volume reporting module structured to provide the apparent plumbing volume, wherein the controller is structured to determine a fresh airflow value to the engine in response to the apparent plumbing volume and control engine operations in response to the fresh airflow value.

2. The system of claim 1, wherein the internal combustion engine is a diesel engine.

3. The system of claim 1, further comprising an exhaust gas recirculation (EGR) system having an EGR outlet operably coupled to the air intake assembly downstream of the MAF sensor.

4. The system of claim 3, wherein the air intake assembly further comprises a turbocharger having an air inlet, the air inlet operably coupled to the air intake assembly upstream of the EGR outlet and downstream of the MAF sensor.

5. The system of claim 3, wherein the operating conditions module is further structured to interpret an EGR off operating condition; and wherein the volume estimation module is further structured to determine the apparent plumbing volume in response to the EGR off operating condition.

6. The system of claim 5, further comprising an EGR control valve operably coupled to the EGR system, wherein the EGR control valve is structured to selectively provide the EGR off operating condition.

7. The system of claim 1, the controller further comprising:

a storage compensation determination module structured to determine the fresh airflow value in response to the current operating condition, the MAF value, the charge flow value and the apparent plumbing volume; and a storage reporting module structured to provide the fresh airflow value.

8. The system of claim 1, wherein the volume estimation module is further structured to determine the apparent plumbing volume utilizing the equation:

$$V_{est} = \frac{(\dot{m}_{in} - \dot{m}_{chg})RT_{chg}}{\dot{P}_{chg}}$$

wherein $\dot{m}_{in}$ is a MAF determined in response to the MAF value, $\dot{m}_{chg}$ is the charge flow value, $V_{est}$ is the apparent plumbing volume, $\dot{P}_{chg}$ is a time derivative of a charge pressure, R is a gas constant and $T_{chg}$ is a temperature of the charge flow value.

9. The system of claim 7, wherein the storage compensation determination module is further structured to determine the fresh airflow value utilizing the equation:

$$\dot{m}_2 = \dot{m}_{in} - \frac{\dot{P}_{chg} V_{est}}{RT_{chg}}$$

wherein $\dot{m}_2$ is the fresh airflow value, $\dot{m}_{in}$ is a MAF determined in response to the MAF value, $V_{est}$ is the apparent plumbing volume, $\dot{P}_{chg}$ is a time derivative of a charge pressure, R is a gas constant and $T_{chg}$ is a temperature of the charge flow value.

10. An apparatus, comprising:

an operating conditions module structured to interpret a mass airflow (MAF) value, a current operating condition, and a charge flow value;

a volume estimation module structured to determine an apparent plumbing volume of an air intake assembly in response to the MAF value, the current operating condition and the charge flow value; and a volume reporting module structured to provide the apparent plumbing volume, wherein the apparatus is further structured to determine a fresh airflow value in response to the apparent plumbing volume and control engine operations in response to the fresh airflow value.

11. The apparatus of claim 10, wherein the operating conditions module is further structured to interpret an exhaust gas recirculation (EGR) off operating condition; and wherein the volume estimation module is further structured to determine the apparent plumbing volume in response to the EGR off operating condition.

12. The apparatus of claim 10, further comprising:

a storage compensation determination module structured to determine a fresh airflow value in response to the current operating condition, the MAF value, the charge flow value and the apparent plumbing volume; and a storage reporting module structured to provide the fresh airflow value.

13. The apparatus of claim 12, further comprising an EGR system operably coupled to the air intake assembly; and wherein the storage compensation determination module is further structured to determine an EGR flow value in response to the fresh airflow value and the charge flow value.

14. The apparatus of claim 10, wherein the volume estimation module is further structured to determine the apparent plumbing volume in response to a transient condition value exceeding a transient condition threshold value.

15. The apparatus of claim 10, wherein the volume estimation module is further structured to determine a plurality of apparent plumbing volumes, each apparent plumbing volume corresponding to an engine operating condition; and wherein in response to the current operating condition and the plurality of apparent plumbing volumes corresponding to engine operating conditions, the volume estimation module is further structured to determine an apparent volume.

16. A method, comprising:

interpreting a mass airflow (MAF) value, a current operating condition, and a charge flow value;

determining an apparent plumbing volume of an air intake assembly in response to the MAF value, the current operating condition and the charge flow value; and providing the apparent plumbing volume.

17. The method of claim 16, further comprising:

interpreting an exhaust gas recirculation (EGR) off operating condition; and determining the apparent plumbing volume in response to the EGR off operating condition.

18. The method of claim 16, further comprising:

determining a fresh airflow value in response to the current operating condition, the MAF value, the charge flow value and the apparent plumbing volume; and providing the fresh airflow value.

19. The method of claim 18, further comprising determining an EGR flow value in response to the fresh airflow value and the charge flow value.

20. The method of claim 19, further comprising operating an internal combustion engine in response to the fresh airflow value and the EGR flow value.

21. The method of claim 16, further comprising storing a plurality of apparent plumbing volume values, each apparent plumbing volume value corresponding to an engine operating condition.

22. The method of claim 21, wherein in response to the current operating condition, the method further comprises selecting one of the plurality of apparent plumbing volume values.

23. The method of claim 18, wherein determining the fresh airflow value further comprises determining a time derivative of a charge pressure.

24. The method of claim 16, further comprising determining if the apparent plumbing volume exceeds a plumbing volume change threshold; and in response to the apparent plumbing volume exceeding the plumbing volume change threshold, setting a fault value.

25. A method, comprising:

providing an internal combustion engine having an air intake assembly, an (exhaust gas recirculation) EGR system having an EGR outlet operably coupled to the air intake assembly and a (mass airflow) MAF sensor operably coupled to the air intake assembly upstream of the EGR outlet;

operating the internal combustion engine with the EGR system closed;

interpreting a current operating condition, a MAF value and a charge flow value;

determining an apparent plumbing volume of the air intake assembly in response to the current operating condition, the MAF value and the charge flow value;

determining a fresh airflow value in response to the current operating condition, the MAF value, the charge flow value and the apparent plumbing volume; and providing the fresh airflow value.

26. The method of claim 25, further comprising determining the apparent plumbing volume in response to a transient condition value exceeding a transient condition threshold value.

27. The method of claim 25, further comprising determining a transient event quality, and wherein determining the apparent plumbing volume is further in response to the transient event quality.

28. The method of claim 27, wherein the determining the apparent plumbing volume further in response to the transient event quality comprises transitioning the apparent plumbing volume toward an observed apparent plumbing volume.

29. The method of claim 28, wherein the transitioning is performed with a time constant determined from the transient event quality.

30. The method of claim 25, further comprising setting a fault value in response to the apparent plumbing volume exceeding a plumbing volume change threshold.

31. The method of claim 25, further comprising determining an EGR flow value in response to the fresh airflow value and the charge flow value.

32. The method of claim 25, wherein determining an apparent plumbing volume of the air intake assembly further comprises:

determining a triggering condition is present; and in response to the triggering condition, determining an apparent plumbing volume.

33. The method of claim 32, wherein the triggering condition is selected from the group of triggering conditions consisting of an initial internal combustion engine startup, an internal combustion engine startup, and a service event.

34. The method of claim 25, further comprising operating the internal combustion engine in response to the fresh airflow value.

* * * * *